United States Patent [19]

Lustenberger

[11] 4,215,854

[45] Aug. 5, 1980

[54] MELT PROCESSING APPARATUS WITH TILTABLE MELT RECEPTACLE

[75] Inventor: Hans Lustenberger, Schaffhausen, Switzerland

[73] Assignee: Georg Fischer Aktiengesellschaft, Switzerland

[21] Appl. No.: 968,730

[22] Filed: Dec. 12, 1978

[30] Foreign Application Priority Data

Dec. 14, 1977 [CH] Switzerland ..... 15360/77

[51] Int. Cl.[2] ..... B22D 41/06; F27B 14/02; F27D 3/14

[52] U.S. Cl. ..... 266/240; 164/336; 266/245; 266/276

[58] Field of Search ..... 266/276, 275, 274, 245, 266/248, 240, 142; 164/336; 294/73

[56] References Cited

U.S. PATENT DOCUMENTS

| | | | |
|---|---|---|---|
| 3,531,074 | 9/1970 | Zelley et al. | 266/240 |
| 3,556,354 | 1/1971 | Ott et al. | 164/336 |
| 3,693,960 | 9/1972 | Golde et al. | 266/276 |
| 3,773,497 | 11/1973 | Greneel | 266/245 |
| 3,790,338 | 2/1974 | Duca | 266/240 |
| 3,818,985 | 6/1974 | Smith | 164/336 |
| 3,923,201 | 12/1975 | Hersh et al. | 164/336 |

FOREIGN PATENT DOCUMENTS

| | | | |
|---|---|---|---|
| 1209255 | 1/1966 | Fed. Rep. of Germany | 164/336 |
| 1285099 | 12/1968 | Fed. Rep. of Germany | 164/336 |

*Primary Examiner*—L. Dewayne Rutledge
*Assistant Examiner*—Peter K. Skiff
*Attorney, Agent, or Firm*—Roylance, Abrams, Berdo & Farley

[57] ABSTRACT

A melt process apparatus having a melt receptacle held on the distal end of a cantilever supported beam. The support for the beam is elevatable and is pivotable about a vertical axis so that the receptacle can be raised, lowered, swung and tilted to facilitate loading, insertion of additives and pouring without transfer vessels and temperature loss. The support for the beam includes a weighing device for monitoring the quantity of melt placed therein. Various embodiments are shown.

11 Claims, 10 Drawing Figures

MELT PROCESSING APPARATUS WITH TILTABLE MELT RECEPTACLE

This invention relates to a melt processing apparatus having a melt processing receptacle tiltable about a horizontal axis, the apparatus being especially useful for the treatment of iron-carbon melt, preferably with pure magnesium, for the production of nodular cast iron.

BACKGROUND OF THE INVENTION

Prior art German Auslegeschrift No. 1,815,214 which discloses an apparatus for the processing of molten metals by introducing evaporable additives. It includes a horizontally movable supporting structure into which is inserted a processing receptacle for the melt, the receptacle being tiltable about a horizontal axis. Thus, the receptacle can be tilted into different operational positions during the filling, processing and discharge cycles.

During filling, the receptacle, also known as a converter, is in the horizontal position, during processing the converter is swung in the upright position and during discharging it is brought into an inclined position with reference to the floor level. A significant disadvantage is that the converter pouring lip during discharging is too close to the floor level for a ladle to be placed underneath the pouring lip.

In order to remove these disadvantages, apparatuses with a tiltable frame as in U.S. Pat. No. 3,747,912 came into use, so that the converter could be tilted about an additional axis in the pouring lip region. Several other disadvantages could, however, not be removed and further ones were added. For example, the supporting structure movable on floor-mounted rails requires a large space, so that also the treatment cabin with suction pipes for the removal of metal vapors must be dimensioned correspondingly, and the rails represent a safety hazard. Still the feed position of the converter is at the same predetermined height, so that in some cases the difference in height between the discharge opening of a furnace and the filling opening of the converter must be bridged by means of a transfer ladle. The decanting and the transport of the melt causes losses in temperature and in time. Also, a back pouring of the washing iron melt into the furnace is not possible without using a transfer ladle. Further, the transport range is limited by the length of the control cables, which can be damaged due to abrasion with the floor and represent a hazard to the workers. The height of the treatment tilt axis above the floor cannot be too small due to the length of the converter and the height of the ladle. As a consequence, a worker must step up and down very frequently. Therefore, two men are required for the operation of the apparatus. A straight transport path of the converter from the filling station to the treatment cabin would often obstruct the traffic on the factory floor. A longitudinal and transverse translational transport device would, however, increase the construction costs as well as the height of the tilt axis unnecessarily. It is rather difficult and costly to exactly weigh the melt poured into this converter in which the tilting frame is supported on a pressure cell in each corner area, due to the large dead weight, the number of pressure cells and the four-point equalization.

All these disadvantages had to be accepted for a long time. In work tests, a fork lift truck modified for carrying a tiltable converter was tried out, but demonstrated no remarkable advantageous results. Although a transfer ladle between the furnace and the converter could be saved upon, two fork lift trucks equipped with converters were needed in order to carry out the necessary numbers of magnesium treatments and consequently the space requirements were larger, partly due to the frontal cantilevel mounting of the load. Due to the operation of the truck, the number of operators could not be reduced. Maneuvering and positioning of the truck exactly below and above the furnace and the ladles, respectively, was time-consuming and demanded a skilled truck operator. A weight tolerance of 3% was achieved, but only under test conditions, e.g., with clean sliding and running surfaces which are difficult to maintain under the rough foundry works conditions. Also, here it was difficult for the filling opening of the converter to follow the pouring lip of the tilting furnace because the maximum lateral adjustable working distance due to the danger of tipping over and other constructive details, could not be too large. For the same reasons, pouring of the melt back into the furnace was connected with security hazards.

BRIEF DESCRIPTION OF THE INVENTION

The object of the invention is to develop an apparatus for processing melt, which requires less space than prior art apparatus, is cheaper to manufacture, safer to operate, is less hazardous and more economical, and which allows a saving in personnel and at the same time a greater weighing accuracy.

Briefly described, the invention includes a melt processing apparatus of the type having a tiltable melt processing receptacle, especially for processing metal casting materials, comprising the combination of a generally horizontally beam having a longitudinal axis, means for mounting the beam for rotational movement about said longitudinal axis, vertical translational movement in a direction generally perpendicular to said axis, and swinging movement about a vertical axis generally perpendicular to the longitudinal axis, and means for attaching the receptacle to an end of the beam so that said receptacle is tiltable about a tilt axis through the receptacle.

The invention further contemplates that the receptacle is tiltable about the longitudinal axis upon rotation of the beam or about an axis transverse to the beam.

The space requirement of the apparatus according to the invention consists mainly of a supporting column held by the floor and or the hall structure. The treatment cabin enclosing the converter has to be dimensioned only to the size of the converter per se. The construction is, therefore, simpler and less expensive. Since no floor-abrading cables and/or hoses are required, and also no rails are needed on the floor and since the melt can be poured without a danger of spilling, the inventive apparatus is safe. In spite thereof, exact paths of movements are guaranteed. The abrasive damage to cables and or hoses is eliminated. The drive system, electromechanical or hydraulic, can be of simpler design. For a much more exact measurement of the weight of the melt, only one measuring or pressure cell is required, which does not have to be designed for a large dead weight and which can be well-shielded against dirt and heat. Therefore, the intervals between repairs are greater. The apparatus can be quickly brought into position, so that cycling times can be reduced which improves economy. Furthermore, no transfer ladle between the furnace and the converter is required. It is of special importance that the apparatus according to the invention can be operated by one man from the floor. He operates a cable-suspended control unit in close vicinity similar to a floor control unit suspended from an overhead crane, so that the need for stepping up and down, on or from the service platform is eliminated, since the converter can be lowered when in a horizontal position, so that the operator can work comfortably. By swiveling, the converter can be moved fast and safely out of the furnace and transit area, so that a practical and space-saving arrangement in the factory hall is possible. The converter can be placed on the factory floor during the treatment procedure. Therefore, shaking and vibrations caused by the reaction of the treatment are not absorbed by the treatment apparatus.

Further inventive features, as well as advantageous embodiments, are described in the subclaims, which may be combined if useful.

The overhung or one-sided mounting arrangement according to claim 2 ensures a largely automatic and consequently faster slag discharge, because the converter can be brought into a vertical discharge position.

In order that the manner in which the foregoing and other objects are attained in accordance with the invention can be understood in detail, particularly advantageous embodiments thereof will be described with reference to the accompanying drawings, which form a part of this specification, and wherein.

Figure 1:
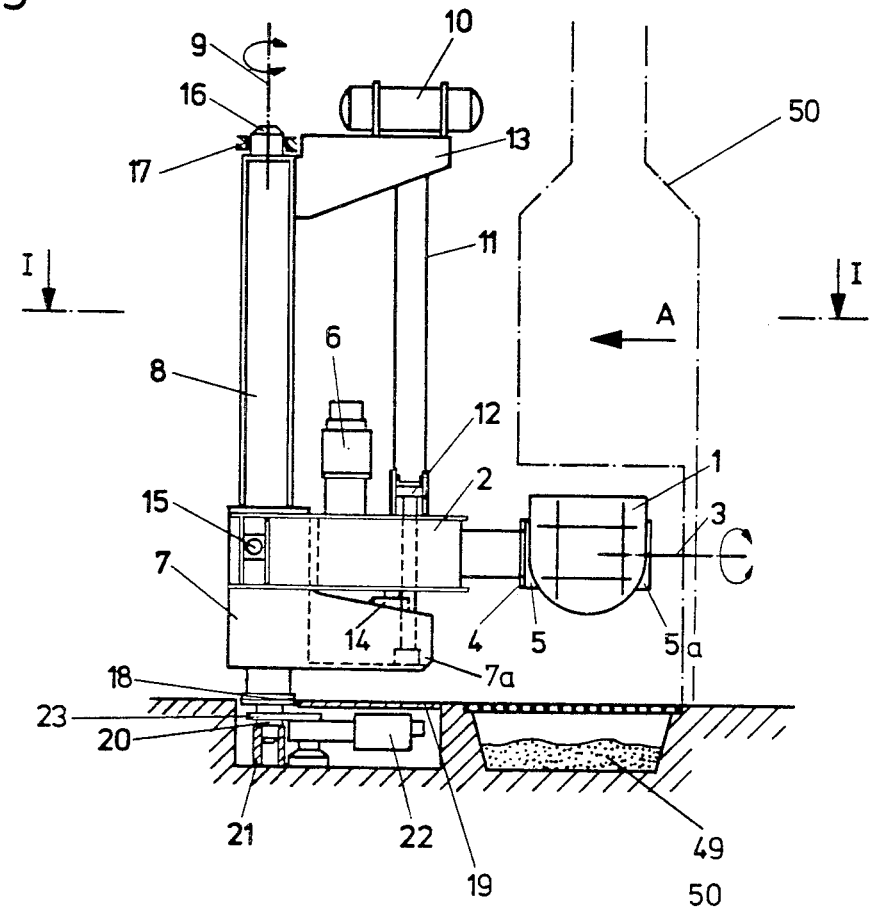
FIG. 1 is a partially schematic side elevation of an apparatus in accordance with the invention.

FIGS 1–4 show a first embodiment of the apparatus with a processing receptacle 1, also known as a converter, which is mounted at the free end of a generally horizontal beam 2 in cantilever fashion, the beam having a rotatable portion mounted for rotation about its central longitudinal axis 2*b* so that the converter 1 is rotatable with that part of the beam about a horizontal tiling axis 3 which, in this embodiment, is the same as the axis 2*b* of the beam 2. The converter is releasably connected to the beam 2 so that it can be replaced as quickly as possible. For this purpose, a connecting flange 4 is provided at the distal end of beam 2, and attaching bosses or flanges 5 and 5*a* are attached at opposite longitudinal sides of the converter 1. Thus, the receptacle can be attached in either of two possible positions to flange 4 at the end of beam 2 to permit discharge from the receptacle in either direction and to provide flexibility in the layout and operation of the apparatus. This is particularly useful for a location of the apparatus between two ovens.

A tilting drive 6 is mounted on the beam 2 and is coupled to the rotatable portion of the beam to cause rotation thereof about axis 2*b*, 3 in order to achieve the tilting movement of the converter 1.

The supported end of beam 2 is coupled to a swivel column 8 by a guide 7 which supports the beam, the guide 7 being vertically movable along the swivel column. Furthermore, the beam 2, the guide 7 and the swivel column 8 are mounted so as to be swivelable or swingable about its longitudinal, vertical axis 9 as a unit. The guide 7 and the beam 2 are vertically adjustable with respect to a floor surface on which the apparatus is disposed by a lifting drive 10 which is coupled to the beam through a cable pull arrangement 11, this being attached to the beam by a pulley roller arrangement 12 attached to guide 7. The lifting drive 10 is mounted on a bracket 13 which is fixedly attached to the upper end of swivel column 8. As will be recognized, a chain hoist, a toothed rack, a spindle or a thrust piston drive can be used instead of the rope or cable pull 11 shown in FIG. 1.

A weighing arrangement 14 in form of a pressure-responsive cell is mounted on a frame portion 7*a* of the guide 7, portion 7*a* extending transversely below beam 2. The weighing arrangement permits monitoring and determination of the quantity of melt fed to the converter 1, which is supported on beam 2, for which purpose the beam 2 is connected articulately with guide 7. Electronic, mechanical or other conventional kinds of weight-responsive devices, can be used for the weighing arrangement 14. The articulate connection between beam 2 and guide 7 is provided by a swivel mounting 15 permitting limited pivotal movement about a horizontal axis through column 8, and a mounting which is suitable for this purpose is shown and will be described in further detail in connection with FIG. 10.

The upper end 16 of the swivel column 8 is rotatably guided in a mounting 17 which is connected to a wall or other fixed building structure, so that column 8 can make a complete revolution.

The lower end 20 of swivel column 8 is rotatably guided in a fixed mounting 21 which is provided with suitable bearings for supporting the entire apparatus. In the area of mounting 21 is a swivel drive 22 equipped with a gear 23 or hydraulic motor or equivalent for rotating the swivel column 8 and, with it, the beam 2 and converter 1. The portion of the apparatus above the floor, except for mounting 17, can be removed by loosening a coupling plate 18 and can be moved to another work station, where anchoring means are also provided. This would, e.g., be desirable during repair work of extended duration on the furnace. The underfloor anchoring beams 21, 22, 23 including drives, are covered by a cover 19 which is flush with the foundry floor. It is, however, also possible to place the swivel drive 22 in the area of the upper mounting 17.

Figure 2:
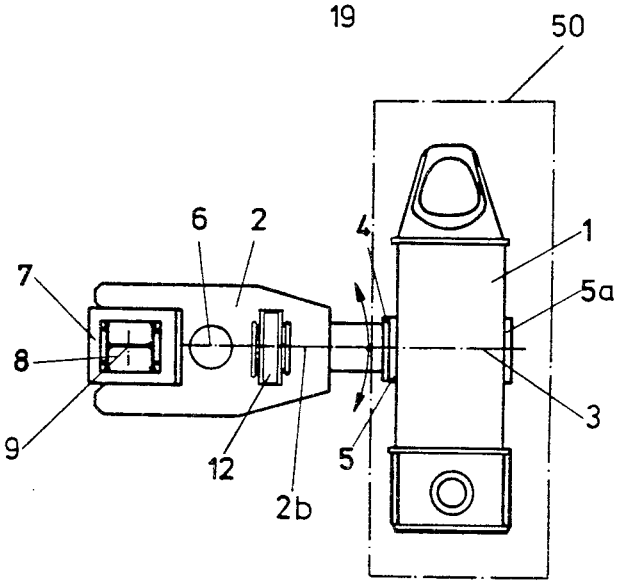
FIG. 2 is a sectional plan view along line I—I of FIG. 1.
Figure 3:
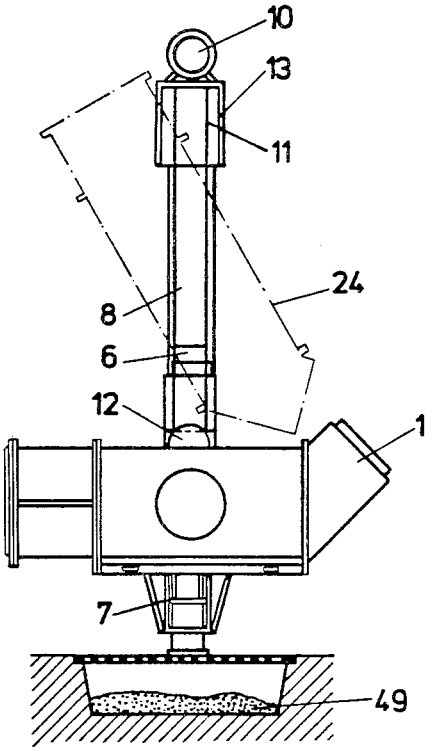
FIGS. 3 and 4 are front elevations of the apparatus of FIGS. 1 and 2, viewed in the direction of arrow A of FIG. 1, showing the tilt receptacle in two different tilting positions.
Figure 4:
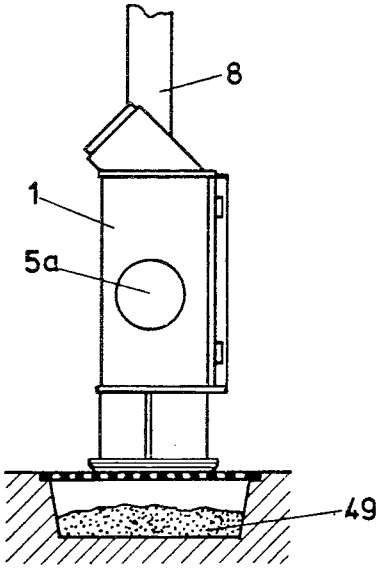

FIGS. 1–4 show the converter 1 in different positions during a processing sequence of the melt. FIGS. 1 and 2 show the receptacle 1 during the filling thereof or transporting of the melt. FIG. 3 shows in dash-dot line 24 the position during discharge. FIG. 4 shows the position during processing such as, for example, during introduction of evaporable additives such as magnesium into the melt. FIG. 1 additionally shows a processing cabin 50 with a suction hood for the metal vapors deposited on the floor of the area in which the apparatus is installed (shown in a dash-dot line) into which the converter 1 may be swiveled during the processing phase.

Figure 5:
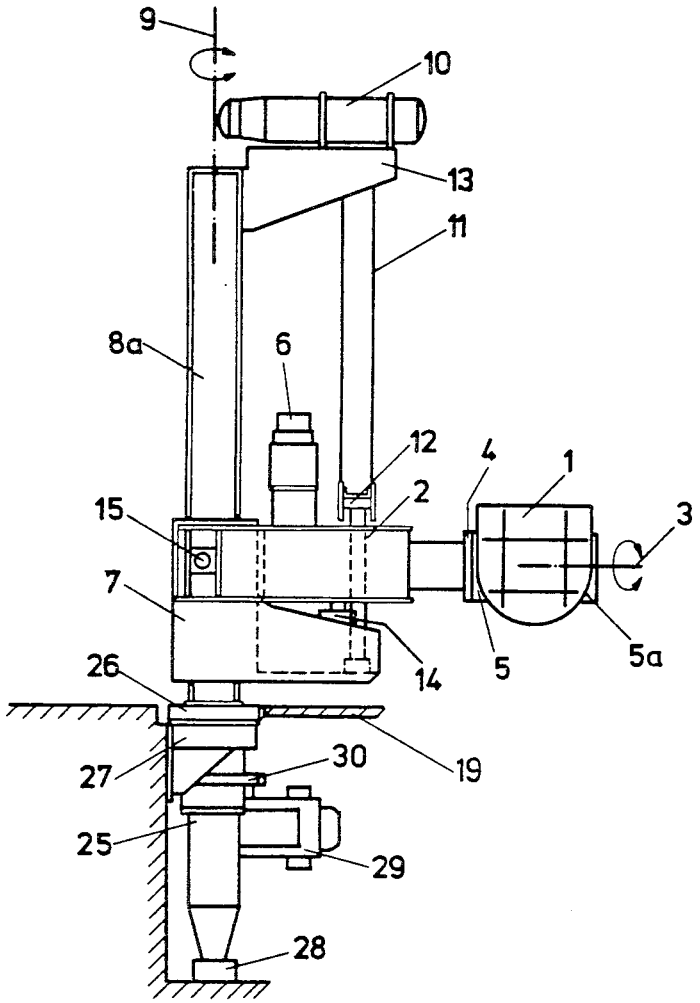
FIG. 5 is a side elevation of a further embodiment of an apparatus in accordance with the invention.

FIG. 5 shows a further embodiment of the apparatus wherein the swivel column 8*a* is mounted unilaterally, i.e., is supported only at the lower under-floor portion 25 by way of a coupling plate 26. This lower part is provided with a fixed thrust and radial bearing 28 and is also provided with an additional radial bearing 27 which is spaced upwardly at a distance from bearing 28. A swivel drive 29 is provided between and in the area of the bearings 27 or 28 for rotating the swivel column 8*a*, the swivel drive 29 being coupled to the column through a drive 30 which can be, for example, a spur gear unit. This embodiment can be dismantled more quickly than the embodiment of FIGS. 1–4 and transported to another work station since there is no upper bearing 17. The other components are the same as in FIGS. 1–4 and are identified by the same reference numerals.

Figure 6:
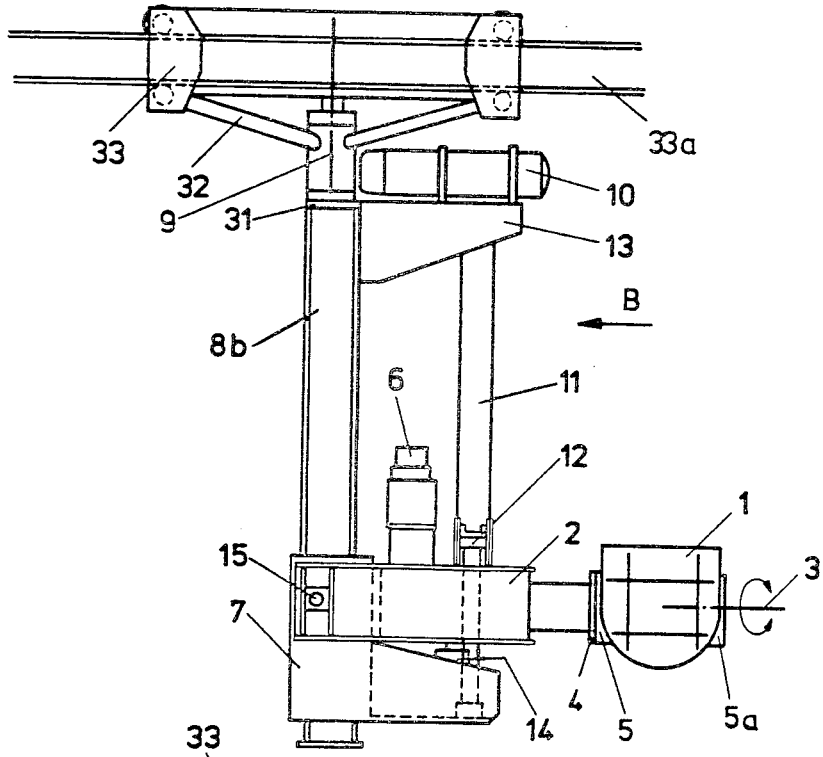
FIG. 6 is a side elevation of a third embodiment of an apparatus in accordance with the invention.
Figure 7:
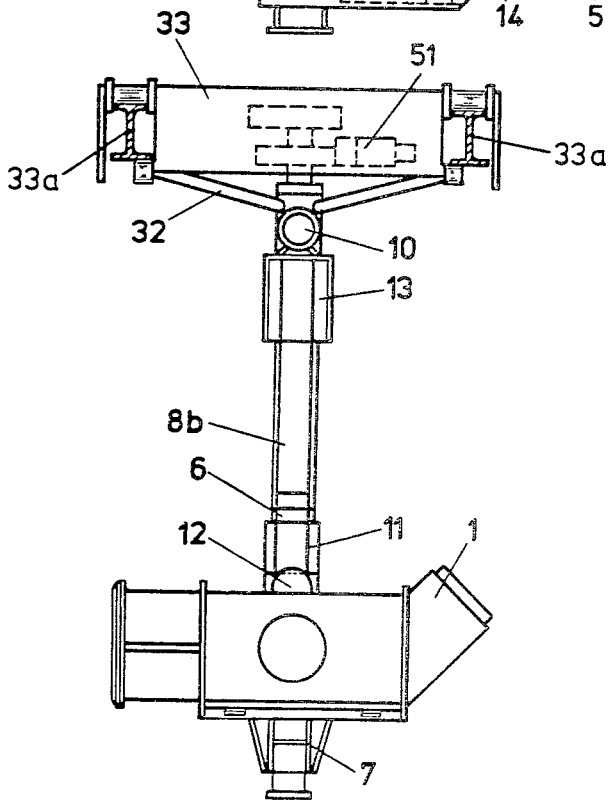
FIG. 7 is a front elevation of the apparatus of FIG. 6 in the direction of arrow B of FIG. 6.

FIGS. 6 and 7 show a further suspended embodiment of an apparatus in accordance with the invention wherein the upper end 31 of a swivel column 8*b* is rotatably mounted in a supporting structure 32 and carriage 33 which, for displacement of the whole apparatus, is rollable along guide rails 33*a*. A swivel drive 51 for rotating the swivel column 8*b* about its vertical axis 9 is mounted on the carriage 33, the construction of the swivel drive and bearings being similar so that described with reference to FIG. 5. Naturally, the rail path system comprising the rails 33*a*, can be mounted in the floor. In a possible embodiment with only one overhead rail, that rail preferably has a square cross section.

Figure 8:
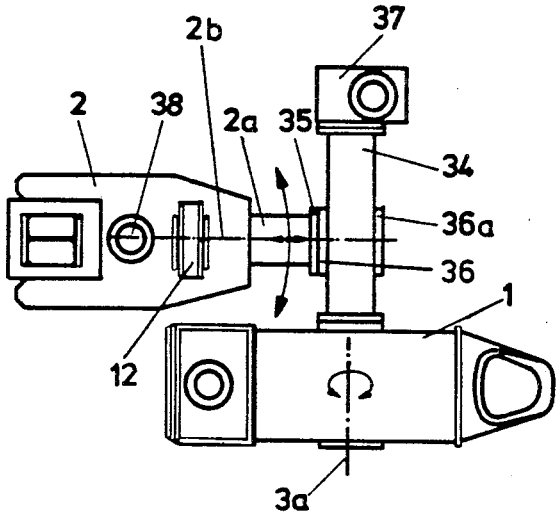
FIG. 8 is a top plan view, similar to FIG. 2, of a further embodiment in accordance with the invention wherein the tilting axis is disposed transversely to the longitudinal axis of the beam.

FIG. 8 shows a supplemental variation of the apparatus wherein, in deviation from FIG. 2, the tilting axis 3*a* of the receptacle 1 runs essentially at right angles to the longitudinal axis 2*b* of beam 2. A transverse beam 34 is attached to the end of beam 2, or on its portion 2*a*, using a flange connection 35. The receptacle 1 is mounted on one end of the beam 34 and a tilting drive 37 for tilting the converter about the axis is provided at the other end of beam 34. The connection of the receptacle 1 with cross-support 34 is releasable, similar to that in the previously described embodiments. Twp opposite connecting flanges 36 and 36*a* for connection to flange 35 of the beam part 2*a* are disposed on the cross-support 34 so that the receptacle 1 may be alternatively mounted in either of the two possible positions, i.e., with the receptacle on either the left or the right side of beam 2 as viewed from the vertical column. In order to increase the range of use of the receptacle 1, the projecting length of beam 2 can be variable in that the projecting part 2*a* can be shifted by a drive 38 in the direction of its longitudinal axis 2*b*.

Figure 9:
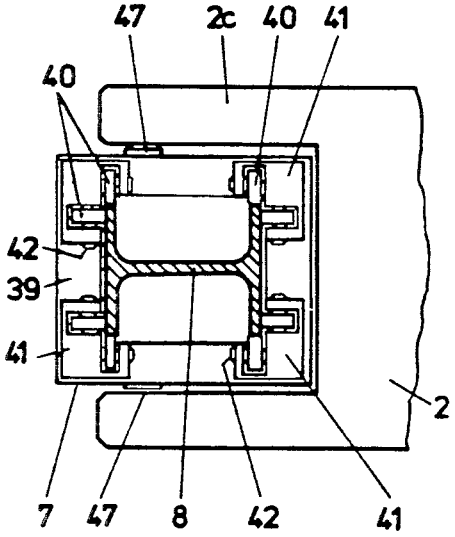
FIG. 9 is an enlarged partial plan view, in partial section, of the elevatable connection mechanism between the beam and pivotable vertical column, usable in the apparatus of FIGS. 1–8.

FIG. 9 shows in greater detail the construction of the guide 7 of the beam 2 on the swivel column 8, 8*a* or 8*b*. Guide rolls 40 are inserted in brackets 41 which are disposed at each side of the swivel column 8, 8*a* or 8*b* in a generally square framework 39 which forms part of guide 7. The swivel columns are preferably produced from material having an I or H-beam sectional configuration. The brackets 41 with the square frame set 39 are releasably connected and are provided to be adjustable toward each side of the swivel column. The guide rolls 40 which are rotatably mounted in the bracket 41 by way of axle bolts 42, may be formed as ball bearings having their outer races made to fit directly against the adjacent surface of the swivel column. The guide rolls 40 are disposed at both ends of the entire guide 7, in a plane running transversely to the swivel column, but they may, however, also be inserted in a fashion such that they are distributed over several planes corresponding to the vertical depth of guide 7.

Figure 10:
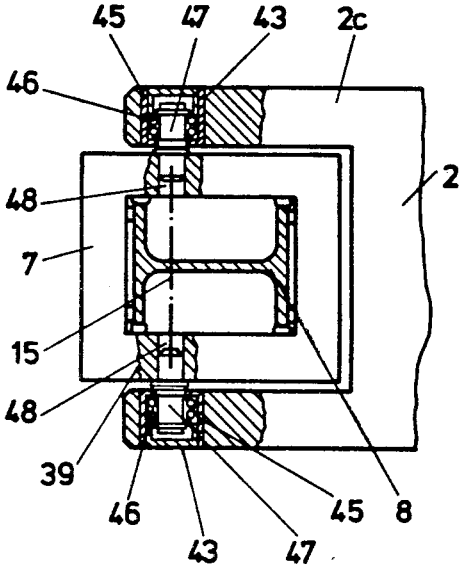
FIG. 10 is an enlarged partial plan view, in partial section, showing in greater detail a pivotable connection between the beam 2 and the elevatable guide mechanism on column 8.

FIG. 10 shows the horizontal swivel axis 15 of the beam 2 in the guide 7. The beam 2 is formed with a bifurcated end having a fork-shaped portion 2*c*, with aligned opposite bores 43 being formed in the two prongs of the fork, the connecting axis 15 of which extends perpendicularly to the vertical axis 9 of the column.

Bearing bushings 45, for the reception and axial support of ball bearings 46, are inserted in bores 43. One end of a bearing pin 47, connecting the beam 2 with the guide 7, is inserted in ball bearings 46, the other end of which is mounted in a bore 48 of the square frame 39 of guide 7. The construction of this swivel axis 15 is determined largely by the size of the beam and of the construction units of the apparatus cooperating therewith, and may therefore also be formed by other constructions such as, for example, by axle pegs inserted fixedly in the prongs of the fork and mounted rotatably in the square frame of the guide.

The converter may also be brought into the most favorable position for discharging of the processing residue such as slag which may be held back in the converter, and the converter may also be brought into a zone secured for any kind of processing, for example, over a bed of sand 49 (FIG. 1) disposed in the floor of a processing cabin. The apparatus can be used for all kinds of customary melting and holding furances and it is possible to accomplish direct refilling of unused melt into the furnace by manipulating one or more drives.

All drives 6, 10, 22, 29 and 37 can be electromechanical, hydraulic or pneumatic.

What is claimed is:

1. A melt processing apparatus having an elongated processing receptacle tiltable about a generally horizontal axis extending perpendicular to the longitudinal axis of said receptacle for producing iron-carbon melt with nodular graphite, the apparatus comprising a generally horizontally extending beam directly coupled to and supporting the receptacle, said receptacle and said beam generally being in the same horizontal plane, a vertical column; and means for supporting said beam on said column, said supporting means being arranged at least partially underneath said beam for vertical movement thereof along the column, said beam, said supporting means and said receptacle being swivelable as a unit about the longitudinal axis of said column, said supporting means including weighing means for measuring the weight of said beam and said receptacle.

2. An apparatus according to claim 1 wherein one side of the receptacle is rotatably mounted to the beam, such that the rotation axis of the receptacle and the tilt axis coincide.

3. An apparatus according to claim 1, wherein the tilt axis passes through the column.

4. An apparatus according to claim 1, wherein the tilt axis runs perpendicular to the longitudinal axis of the beam.

5. An apparatus according to claim 1, wherein the length of the beam is adjustable.

6. An apparatus according to claim 2 wherein said receptacle is provided with connecting flanges on both its longitudinal sides to permit the receptacle to be connected or disconnected from said beam in two different positions.

7. An apparatus according to claim 1 wherein the beam is tiltable about a horizontal axis passing through the column.

8. An apparatus according to claim 1, which further includes an anchoring device for rotatably supporting said vertical column, and wherein said apparatus is detachable and movable from one predetermined work location to another.

9. An apparatus according to claim 8, wherein the anchoring device is mounted below floor level and is connectable with the part of the apparatus above floor level by means of a coupling plate.

10. An apparatus according to claim 8, and further comprising means comprising a rail path system along which the apparatus is movable.

11. An apparatus according to claim 10, wherein the column is movable horizontally along at least one overhead rail.

* * * * *